United States Patent [19]

Bertsch et al.

[11] 4,428,345

[45] Jan. 31, 1984

[54] FUEL METERING SYSTEM FOR AN INTERNAL COMBUSTION ENGINE

[75] Inventors: Richard Bertsch, Asperg; Dieter Günther, Murr; Michael Horbelt, Schwieberdingen; Bernd Kraus, Gerlingen; Jürgen Penschuck, Möglingen; Claus Ruppmann, Schwieberdingen; Hans Schnürle, Walheim, all of Fed. Rep. of Germany

[73] Assignee: Robert Bosch GmbH, Stuttgart, Fed. Rep. of Germany

[21] Appl. No.: 378,948

[22] Filed: May 17, 1982

[30] Foreign Application Priority Data

May 20, 1981 [DE] Fed. Rep. of Germany ..... 3119969
May 13, 1982 [DE] Fed. Rep. of Germany ..... 3214059

[51] Int. Cl.[3] ..... F02M 7/00; F02M 51/00
[52] U.S. Cl. ..... 123/440; 123/489
[58] Field of Search ..... 123/440, 489, 589

[56] References Cited

U.S. PATENT DOCUMENTS

| | | | |
|---|---|---|---|
| 4,073,269 | 2/1978 | Herth et al. | 123/489 |
| 4,140,086 | 2/1979 | Schnurle et al. | 123/489 X |
| 4,210,106 | 7/1980 | Wessel et al. | 123/489 |
| 4,251,989 | 2/1981 | Norimatsu et al. | 123/489 X |
| 4,300,507 | 11/1981 | Reddy | 123/489 |

*Primary Examiner*—Tony M. Argenbright
*Attorney, Agent, or Firm*—Edwin E. Greigg

[57] ABSTRACT

A fuel metering system having a λ regulation device in which the delay periods known per se from the prior art are variable upon the switchover of the integration direction of an integrator included in the λ regulation system. This variation produces a shortening of the delay period, as a result of which it is possible to prevent an excessive enrichment of the mixture. The invention relates to a controllable reduction of the individual delay signal as well as a control of the total duration of control exerted on the delay signals as they appear. The invention is independent of whether it is realized by either analog or digital circuit technology.

15 Claims, 21 Drawing Figures

FUEL METERING SYSTEM FOR AN INTERNAL COMBUSTION ENGINE

BACKGROUND OF THE INVENTION

The invention relates to a fuel metering system having apparatus for regulating the composition of the fuel-air mixture reaching the combustion chambers of an internal combustion engine by means of a sensor disposed in the flow of exhaust gas of the engine.

U.S. Pat. No. 4,073,269, issued Feb. 14, 1978 to Herth et al, describes a fuel metering system for an internal combustion engine having this type of apparatus for regulating the air/fuel ratio of the combustible mixture. The apparatus includes a threshold switch which is connected to receive the output signal of the sensor. The threshold switch output is connected with the input of an integrator which integrates in alternating directions, depending upon the output signal of the threshold switch. The apparatus also includes a delay device, which is connected with the threshold switch output to respond to a changing threshold switch output signal, for delaying the switchover of the integrator from one integrating direction to the other integrating direction for a predetermined, adjustable delay period. These delay periods are provided for this switchover so that a certain shift in the mixture toward "rich" is attained at the optimal operational point of a catalytic converter disposed in the flow of exhaust gas downstream of the sensor.

However, in the case of relatively high-frequency exhaust gas sensor switching cycles, a repeated "setting of the delay period" causes an undesired and uncontrolled shift toward a rich mixture. This, in turn, substantially worsens the exhaust emissions. The higher-frequency switching procedures are caused by individual rich or lean cylinders, and this nonuniformity in the mixture composition can be caused both by the fuel metering and by a pulsation of the aspirated air quantity. A suitable selection of the installation point of the sensor can substantially prevent this effect because of an improved homogenization of the exhaust gas. However, this cannot be realized in all cases because of other peripheral conditions determining the installation of the sensor such as temperature, space available for installation, and sensor response time.

OBJECT AND SUMMARY OF THE INVENTION

The fuel metering system according to the invention is similar to that described in the above-referenced U.S. Pat. No. 4,073,269, except that it further includes a control device for shortening or suppressing the delay periods for a predetermined period of time after the elapse of each delay period produced by the delay device.

The fuel metering system according to the invention has the advantage over the prior art that even with higher-frequency voltage jumps on the part of the sensor, an excessive shift to a rich mixture can be avoided.

The invention will be better understood and further objects and advantages thereof will become more apparent from the ensuing detailed description of a preferred embodiment taken in conjunction with the drawings.

DESCRIPTION OF THE PREFERRED EMBODIMENTS

Figure 1:
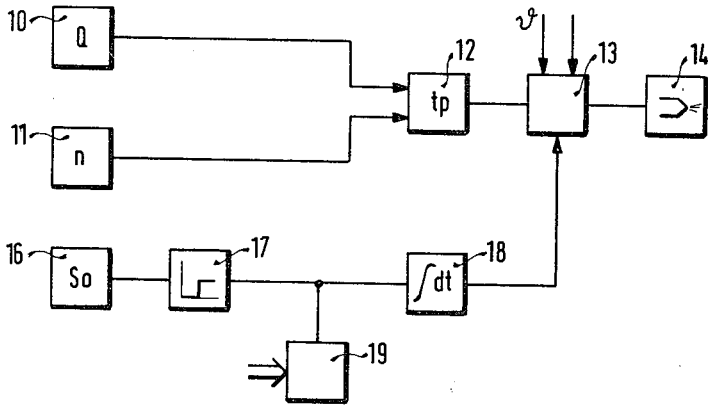
FIG. 1 is a block circuit diagram of an injection regulating system.

FIG. 1, as a block circuit diagram, shows the basic structure of a fuel metering system where the fuel is injected intermittently into the intake tube in synchronism with the rpm. It must be stressed that the type of fuel metering, whether fuel injection or a carburetor system, represents no restriction whatever on the fuel metering system according to the invention.

In the subject of FIG. 1, an air flow rate meter 10 and an rpm meter 11 are shown. They furnish their output signals to a subsequent timing element 12, which is followed in turn by a correction circuit 13 and finally by at least one injection valve 14. The input variables for the correction circuit 13 are various engine operating characteristics, such as temperature, acceleration, and above all the correction signal for the λ regulation which is of interest here. This signal proceeds via an input 15 into the signal processing within the correction circuit 13. A sensor 16 in the exhaust pipe of the engine and a subsequent threshold switch 17 and an integrator 18 serve as the means of realizing the λ regulation. The threshold switch 17 detects the jumps in the output signal of the sensor 16, and the subsequent integrator 18 varies its integration direction as a consequence of a variation in the output signal of the threshold switch 17.

A timing element 19 serves as the device for effecting the required shift toward richness in the mixture. This timing element 19 influences the output signal of the threshold switch 17, or the input signal of the following integrator 18 in such a way as to prolong the signal in at least one switchover direction of the threshold switch 17.

Figure 2:
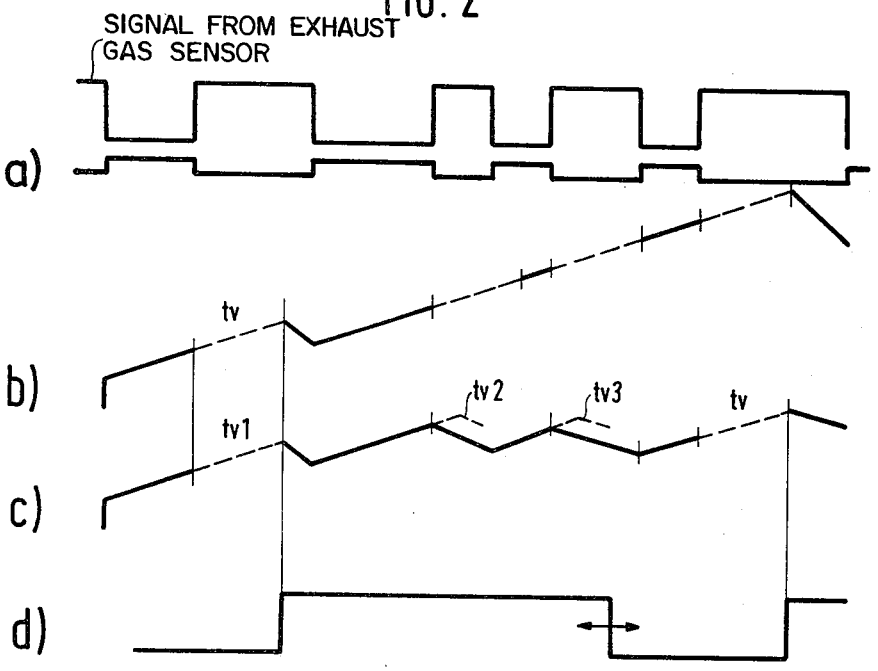
FIGS. 2(*a*) through 2(*d*) show various diagrams of system values versus time for explaining the invention.

The basic structure of an injection system for an internal combustion engine shown in FIG. 1 is known from the above-referenced U.S. Pat. No. 4,073,269. In order that the invention will be understood, the differences between what is known and what is novel will now be discussed, with the aid of the signal courses illustrated in FIG. 2.

FIG. 2*a* shows the output signal of the threshold switch 17 which follows the sensor 16. The individual switching thresholds indicate the respective transitions from a rich mixture to a lean mixture and vice versa.

In FIG. 2*b*, the output signal of the integrator 18 is shown. A prolongation of the upward integration can be seen following each change of signal to positive in the signal course of FIG. 2*a*. This prolongation will also be called "delay period" below, since it delays a change in the direction of integration. In order to illustrate the problem particularly clearly, the delay period tv is shown as exaggeratedly large in FIG. 2*b*. The same effect is found, however, in higher-frequency switching cycles of the sensor as a consequence of asymmetry in the exhaust gas. It is possible, for instance, for one or more cylinders to receive a mixture which is nonuniformly richer than that in the other cylinders, and then it may happen under some circumstances that at each exhaust stroke of that cylinder or those cylinders, a corresponding "rich" signal of the exhaust gas sensor will appear, while at the times of the exhaust strokes of the other cylinder, a lean mixture is signalled.

A comparison of the two diagrams in FIG. 2*a* and FIG. 2*b* shows the special effect of a constant delay time tv. When there is an unfavorable relationship between the switching frequency of the sensor and the magnitude of the delay period tv, the ever-increasing enrichment of the mixture shown in FIG. 2*b* is the result. This enrichment lasts until such time as the combustion residues of even the last cylinder indicate a rich mixture, and the sensor no longer indicates a cylinder-specific lean signal.

The excessive enrichment of the mixture shown in FIG. 2*b* is undesirable, for reasons of clean exhaust emissions. This enrichment can be avoided if the delay period is not constant but instead is more or less retracted or set back to zero after a first delay period has elapsed. This can be seen in the diagram of FIG. 2*c*. There, the first delay period tv takes a normal course, and then this delay period is reduced to zero, or in other words suppressed completely, for a specific control period thereafter (FIG. 2*d*). The control period as shown in FIG. 2*d* may be variable and in particular may be kept dependent on operating characteristics.

In the diagram of FIG. 2*c*, broken lines indicate an alternative with a delay period tv2 following the first delay period tv but not retracted back to zero, as well as a corresponding third delay period tv3.

After the control period shown in FIG. 2*d* has elapsed, the initial status is resumed. This means that there will be a new delay period upon the appearance of a new switching cycle of the threshold switch.

It is the object of the invention to reduce the enrichment as shown in FIG. 2*c* in comparison with the diagram of FIG. 2*b*.

In connection with FIG. 2*d*, a "control period" was discussed; naturally a certain number of switching cycles can also be made the basis for this control period. It is also possible to count out a predetermined number of engine revolutions. Finally, good results are also likely from a delay period tv dependent on the switching frequency, because the degree of enrichment in the example of FIG. 2*b* depends on the frequency with which switching of the comparator 17 of FIG. 1 takes place.

Figure 3:
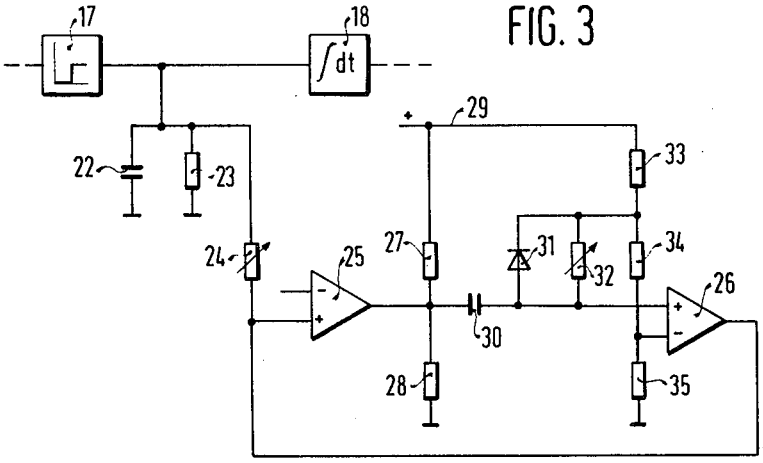
FIG. 3 is a circuit diagram for one possible realization of a timing element to form the delay period.

One example of the timing element of the subject of FIG. 1 for reducing the delay periods following the appearance of a first delay period is shown in FIG. 3. Its primary component is a resistor-capacitor member with a capacitor 22 and a resistor 23. This R-C combination is connected directly to ground from the junction point of the comparator 17 and the integrator 18.

The end of the resistor 23 remote from the ground line is furthermore coupled with the positive input of a differential amplifier 25 and the output of a further differential amplifier 26. From the output of the first differential amplifier 25, the resistor 27 and 28 each lead to a positive line 29 and to ground, and a capacitor 30 leads to the positive input of the second differential amplifier 26. This positive input is connected via a parallel circuit of diode 31 and resistor 32 at the output of a two-stage voltage divider comprising three resistors 33, 34 and 35; this voltage divider is likewise located between the terminals for supply voltage, and its second input is carried to the negative input of the differential amplifier 26. The basic concept of the subject of FIG. 3 is switching a second resistor 24 parallel to the resistor 23 following the appearance of the first delay period determined by the capacitor 22 and the resistor 23, thus shortening the subsequent delay periods. This occurrence is indicated by the delay periods tv2 and tv3 of FIG. 2*c* indicated by broken lines.

Figure 4:
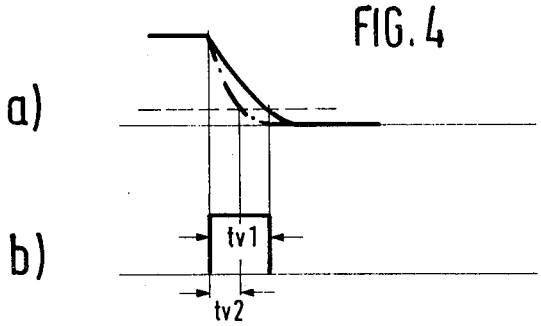
FIGS. 4(*a*) and 4(*b*) include diagrams of system values versus time for explaining the subject of FIG. 3.

The subject of FIG. 3 will efficaciously be explained with the aid of the two pulse diagrams of FIG. 4. FIG. 4*a* shows the potential on the connecting line from the threshold switch 17 and the integrator 18. If the threshold switch 17 switches its output potential to a lower value, then the capacitor 22, acting to store energy, causes a looping of the trailing edge with a time constant determined by the values of the R-C member. The signal on the line connecting the threshold switch 17 and the integrator 18 is interrogated as to a threshold value by means of the differential amplifier 25, and if this threshold value fails to be attained, then its output potential returns to a low value. This voltage drop is transferred via the capacitor 30 to the positive input of the next differential amplifier 26, so that this element switches in that direction as well, and its output voltage drops. In the final analysis, however, a reduction of the output potential of the second differential amplifier 26 causes a parallel connection of the resistor 24 to the resistor 23 and thus a reduced time constant of this R-C member.

At the same time, a low output potential of the differential amplifier 26 acts on the first differential amplifier like a holding conection, until such time as the capacitor 30 has again been charged in the corresponding direction and the potential at the positive input of the amplifier 26 has thus risen once again to a predetermined threshold value. This recharging process elapses with a time constant dependent on the capacitance of the capacitor 30 and the resistance value of at least the resistor 32. During this recharging time, the resistor 24 is parallel to the resistor 23 and the result is accordingly a shorter delay period tv2 as shown in FIGS. 4*a*, 4*b*.

The resistor 24 of the subject of FIG. 3 is shown as variable. With it, the duration of the second and subsequent delay times can be set in comparison to the first delay time. The overall period of influence, however (see FIG. 2*d*) is dependent, for example, on the value of the resistor 32 of FIG. 3.

When the resistance value of resistor 24 is near zero, the duration of delay of the second and further delay times can be reduced to near zero. However, the prerequisite in that case is that a resistor is inserted between the line connecting the threshold switch 17 with the integrator 18 and the remaining circuitry, so that for the full duration of control, no short-circuiting of the output signal of the threshold switch 17 will occur.

The magnitude of the reduction of the individual delay periods and the total duration of the control period are specific for certain engines and must be adapted to characteristics of given instances. The control of these periods can be accomplished in accordance with engine operating characteristics so long as the intention is, for instance, to increase their influence at low rpm. The effect of nonuniform distribution of the individual mixtures described in connection with FIG. 2 in a multicylinder engine was in fact observed in a multicylinder engine at low rpm.

While the information provided thus far for realizing the invention are ascribable to analog circuit technology, the invention can naturally also be applied to a digital signal processing system. One example for the corresponding portion of an electronically controlled fuel metering system is shown in FIG. 5.

Figure 5:
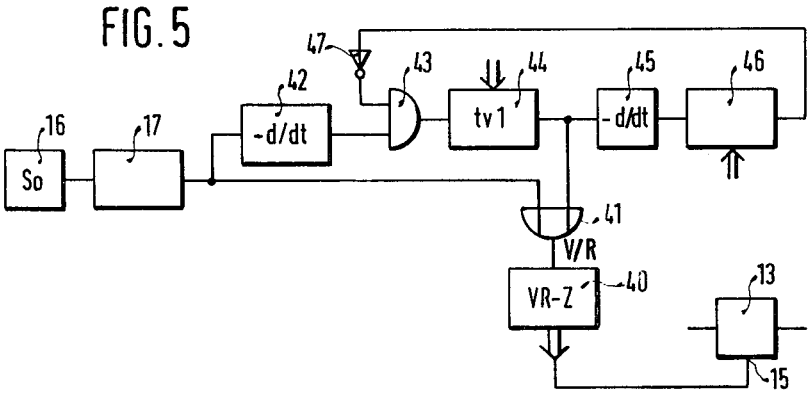
FIG. 5 is a basic illustration of the elements essential to the invention in the fuel metering system when it is realized in digital form.

The primary feature of the subject of FIG. 5 is a forward-backward counter 40, which assumes the function of the integrator 18 of FIG. 1. The output of the threshold switch 17 leads to an input of an OR gate 41, which is coupled on the output side with the counting-direction input of the counter 40. A series circuit comprising a differentiation circuit 42, AND gate 43, timing element 44, differentiation circuit 45 and a further timing element 46 also follows the output of the threshold switch 17. The further timing element 46 is switched on the output side via an inverter 47 to the second input of the AND gate 43. The second input of the OR gate 41 is also connected to the output of the first timing element 44. This first timing element 44 determines the duration of the first delay period tv1, while the second timing element 46 determines the full duration of the control period as shown in FIG. 2*d*. Intervention opportunities indicated by arrows for both timing elements 44 and 46 show that they are controllable in accordance with engine operating characteristics.

If the output signal of the threshold switch 17 is at a high value, then by definition the counter 40 should count in the positive direction. After the appearance of a negative signal edge in the output signal of the threshold switch 17, the differentiation element 42 switches and triggers the subsequent timing element 44, so that for the duration tv1, the counting direction of the counter 40 remains the same via the OR gate 41. After the time tv1 period of the timing element 44 has elapsed, the counting direction of the counter switches over, so long as the output signal of the threshold switch 17 is still at a high value.

The elapse of the first time period in the timing element 44 in turn results in the triggering of the second timing element 46, so that the AND gate 43 blocks because of the signal reversal in the inverter 47; the result is that every further triggering of the first timing element 44 occurring during the control period, which in turn is determinable by the second timing element, is suppressed. The resultant signal behavior of the entire circuit of FIG. 5 accordingly corresponds to the diagram of FIG. 2*c*.

The above-described control of the duration of the control period (FIG. 2*d*) can be changed, for instance to the frequency of the switching cycles of the threshold switch 17, by replacing the timing element 46 with a counter having a subsequent decoding circuit and by the counter's being triggered each time by the output signal of the threshold switch 17.

The frequency dependence of the the delay period control is attained by replacing the differentiation element 45 which precedes the timing element 46 with a frequency-recognition circuit, and by picking up the input signal for the frequency-recognition circuit directly from the output of the threshold switch 17, for example.

Figure 6:
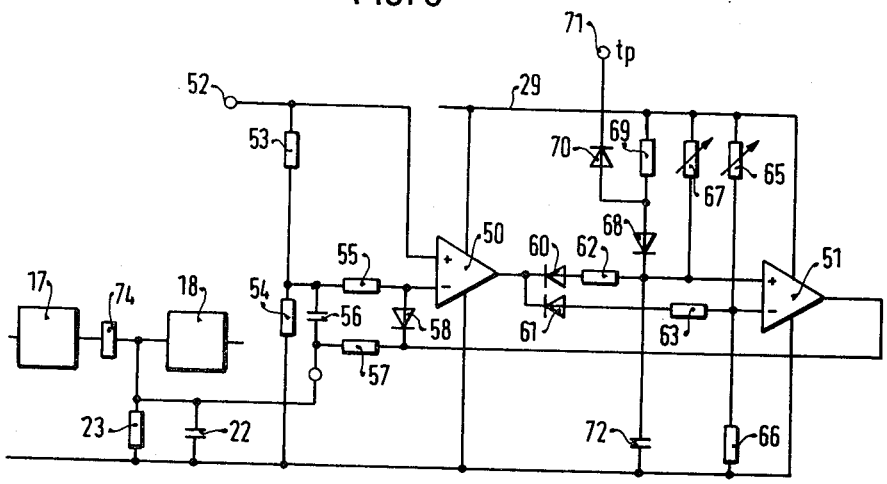
FIG. 6 shows a further exemplary embodiment of an apparatus corresponding to FIG. 3.

FIG. 6, in the form of a circuit diagram, shows a further possible realization of a timing element 19 for forming the delay period. Two operational amplifiers are identified by reference numerals 50 and 51. At the positive input of the operational amplifier 50 there is a constant potential, corresponding to that of a terminal 52. A voltage divider comprising two resistors 53 and 54 is disposed between this terminal 52 and the ground line. The junction point between the two resistors 53 and 54 is connected via a resistor 55 to the negative input of the operational amplifier 50. The parallel circuit comprising resistor 23 and capacitor 22 already known from FIG. 3 is connected via a capacitor 56 to the junction point of the two resistors 53 and 54 and is connected via a series circuit of a resistor 57 and a diode 58 to the negative input of the amplifier 50. From the output of this amplifier 50, two series circuits, each comprising a diode 60 or 61, respectively, and a resistor 62 or 63, respectively, lead to the positive and negative inputs, respectively, of the subsequent operational amplifier 51. In addition, this negative input is connected via respective resistors 65 and 66 with the positive line 29 and the ground line, respectively. The positive input of this operational amplifier 51 is coupled first via a resistor 67 with the positive line 29 and parallel to this resistor 67 there is a series circuit comprising a diode 68 and resistor 69, from the junction point of which a diode 70 leads to a connection terminal 71 for a tp signal. This tp signal corresponds to the output signal of the timing element 12 of FIG. 1. Finally a capacitor 72 at the positive input of the operational amplifier 51 is also connected to ground. On the output side, the operational amplifier 51 is connected with the coupling point of the resistor 57 with the diode 58.

Figure 7:
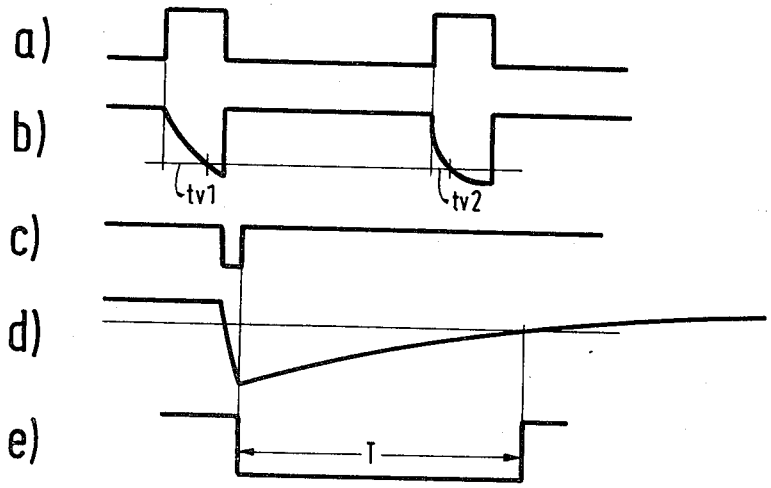
FIGS. 7(*a*) through 7(*e*) and 8(*a*) through 8(*f*) are pulse diagrams explaining the mode of operation of the subject of FIG. 6.
Figure 8:
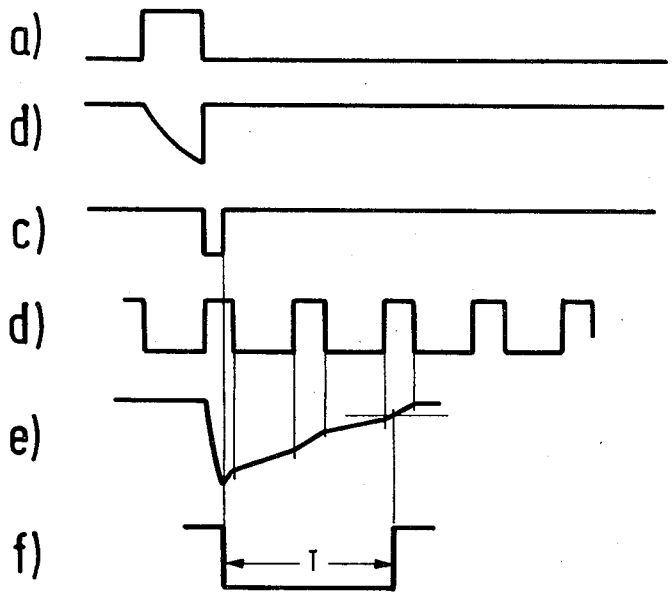

The circuit layout shown in FIG. 6 will now be efficaciously explained with the aid of the pulse diagrams of FIGS. 7 and 8.

FIG. 7*a* shows the output signal of the lambda sensor 16. Low potential in the signal means a lean mixture, and high potential signifies a rich mixture. The voltage course over the capacitor 22 is shown in FIG. 7*b*. With a rich mixture, the voltage over the capacitor 22 is reduced in accordance with the time constant of the R-C member 22, 23 and with a lean mixture it is increased to a high potential. The inverse signal course which can be seen from the pulse diagrams of FIGS. 7*a* and 7*b* is attained by means of an inverter 74 following the threshold switch 17. FIG. 7 furthermore shows various trailing and leading edges, which are a function of the chosen dimensions of the output stage of the inverter 74. As shown in FIG. 7*b*, a looped trailing edge and the steepest possible leading edge is the desired goal.

Normally, the output level of the operational amplifier 50 is at a high value. With the leading edge of the signal of FIG. 7*b*, the negative input of this operational amplifier 50 is briefly directed to be positive, so that the output potential breaks down for a short period of time, as shown in FIG. 7*c*. This signal drop is transferred to the subsequent operational amplifier 51. As a result, its output signal breaks down in turn, and the operational amplifier 51 will switch back again only when, because of the charging process of the capacitor 72, the voltage at the positive input of the amplifier has once again attained a predetermined threshold value. These conditions are illustrated by FIGS. 7*d* and 7*e*.

As long as a zero signal is present at the output of the operational amplifier 51, then the resistor 57 is in a parallel circuit with the resistor 23, so that the trailing edge in the signal of FIG. *7b* becomes much steeper. Because of this steeper drop, the subsequent retardation period tv2 is also reduced; in an extreme case, it can be reduced to essentially zero. After the period of time illustrated in FIG. *7e* has elapsed, the discharging process of the capacitor 22 is affected solely by the resistor 23, so that the original time constant again comes into play.

The illustration provided by FIG. 7 still does not show any influence of load dependency on the time period T of FIG. *7e*. If tp pulses are fed into the system via the connection terminal 71, the result is signal behavior as shown in FIG. 8. In the absence of a tp pulse, the connection terminal 71 is maintained at ground potential so that the capacitor 72 is charged solely by current flowing from the positive line 29 through the resistor 67, and the diode 68 is reverse-biased. When a positive tp pulse is applied to the connection terminal 71, the diode 68 is rendered conductive and the capacitor 72 is charged by current from the positive line 29 flowing through both the resistor 67 and the series combination of resistor 69 and diode 69 connected in parallel with the resistor 67. Thus, with every tp pulse within the period of time T, the capacitor 72 of the circuit layout of FIG. 6 is charged to an amplified degree, shortening the total duration of time until the threshold value which is the criterion for the switching of the operational amplifier 51 has been attained. This process can be seen in FIG. *8e*.

In the exemplary embodiment of FIG. 6, the circuit layout is provided with tp pulses. They are derived from the timing element 12 of FIG. 1 and correspond in value to the quotient of the air throughput in the intake tube divided by the rpm. These are basic injection pulses. However, it may be efficacious instead to process pure rpm pulses or pure clock pulses as well as mixed forms, which additionally take into consideration such factors as temperature.

The foregoing relates to preferred exemplary embodiments of the invention, the latter being defined by the appended claims.

What is claimed and desired to be secured by Letters Patent of the United States is:

1. In a fuel metering system for an internal combustion engine having an apparatus for regulating the composition of a fuel-air mixture reaching the combustion chambers of the engine, wherein the apparatus includes a sensor, which is disposed in a flow of exhaust gas from the engine, for generating a control voltage in accordance with the air-fuel ratio of the fuel-air mixture, a threshold switch, having an input connected to receive the control voltage generated by the sensor and having an output, for generating an output signal which switches from a first level to a second level whenever the sensor control voltage exceeds a predetermined threshold voltage, an integrator, having an input connected to receive the threshold switch output signal and having an output, for integrating in alternating directions depending upon the threshold switch output signal, an electronic control unit, connected to receive the integrator output signal, for controlling the composition of the fuel-air mixture in accordance with the integrator output signal, and first delay means, connected between the output of the threshold switch and the input of the integrator for delaying the switchover of the integrator from one integrating direction to the other integrating direction for a first, predetermined, delay period, the improvement which comprises:

delay control means for rendering the first delay means inoperative for a predetermined control period after each first delay period.

2. A fuel metering system, as described in claim 1, which further comprises:

second delay means, which is rendered operative by the delay control means during the predetermined control period, for delaying the switchover of the integrator from the one integrating direction to the other integrating direction for a second predetermined delay period.

3. A fuel metering system, as described in claim 2, wherein each second delay period is shorter than the preceding first delay period.

4. A fuel metering system, as described in claim 3, wherein the predetermined control period corresponds to a predetermined total number of possible second delay periods.

5. A fuel metering system, as described in claim 1, wherein the first delay means includes adjustment means for adjusting the first delay period in accordance in accordance with engine operating characteristics.

6. A fuel metering system, as described in claim 2, wherein the second delay means includes adjustment means for adjusting the second delay period in accordance with engine operating characteristics.

7. A fuel metering system, as described in claim 4, wherein the second delay means includes adjustment means for adjusting the total number of possible second delay periods determining the control period.

8. In a fuel metering system having a lambda regulating apparatus based on exhaust gas composition which includes an exhaust gas sensing means for generating a first signal which switches between a first voltage level signifying a rich fuel-air mixture and a second voltage level signifying a lean fuel-air mixture, signal integrating means for integrating in alternating directions depending on the first signal, and delay means for delaying the switchover of the integrating means from one integrating direction to the other integrating direction for a predetermined delay period, the improvement which comprises:

delay control means for controlling the delay means so as to reduce any delay periods occurring during a predetermined time period T directly following an initial delay period.

9. A fuel metering system, as described in claim 8, wherein the delay control means controls the delay means so as to substantially suppress any delay periods occurring during the predetermined time period T.

10. A fuel metering system, as described in claim 8, wherein the delay control means comprises time period means for varying the time period T in accordance with at least one engine operating characteristic.

11. A fuel metering system, as described in claim 10, wherein said at least one operating characteristic comprises a non-corrected injection time tp.

12. A fuel metering system, as described in claim 10, wherein said at least one operating characteristic comprises a load signal.

13. A fuel metering system, as described in claim 10, wherein said at least one operating characteristic comprises an engine rpm.

14. A fuel metering system, as described in claim 10, wherein said at least one operating characteristic comprises an engine temperature.

15. A fuel metering system, as described in claim 8, wherein the delay control means further comprises adjustment means for varying the reduction of the delay periods in accordance with at least one engine operating characteristic.

* * * * *